United States Patent [19]

Montagino et al.

[11] Patent Number: 4,926,027

[45] Date of Patent: May 15, 1990

[54] FORCED HOT AIR APPLIANCE WITH SWIVEL HANDLE

[75] Inventors: James G. Montagino; Betty Butzko; Ronald L. Lerner, all of El Paso, Tex.

[73] Assignee: Helen of Troy Corporation, El Paso, Tex.

[21] Appl. No.: 388,525

[22] Filed: Aug. 2, 1989

[51] Int. Cl.[5] ..... H05B 3/02

[52] U.S. Cl. ..... 219/222; 219/221; 219/227; 132/271

[58] Field of Search ..... 219/221, 222, 227; 132/145, 151, 118, 226–229, 232, 269, 271

[56] References Cited

U.S. PATENT DOCUMENTS 3,731,694 5/1973 Moro ..... 219/222
4,469,934 9/1984 Isshiki ..... 219/222

FOREIGN PATENT DOCUMENTS 0043549 4/1977 Japan ..... 219/222

*Primary Examiner*—Bruce A. Reynolds
*Assistant Examiner*—Leon K. Fuller
*Attorney, Agent, or Firm*—Watson, Cole, Grindle & Watson

[57] ABSTRACT

A forced hot air appliance comprises a main handle housing assemble that is generally tubular, a heater which is mounted within the main handle housing for heating air which flows therepast, a ventilator for forcing air to flow through the main handle housing, a bearing assembly which includes a generally tubular bearing sleeve, a swivel handle assembly including a head portion and a body portion, the head portion having a rear end which defines an air inlet screen and a front end which defines a circular opening through which the rear portion of the bearing sleeve extends for enabling the bearing sleeve and the main handle housing to be rotatably supported, and a submersible switch which is mounted within the swivel handle housing including a switch box and two spaced apart metallic contact which contact metallic contact rings on the bearing sleeve of the bearing assembly regardless of the rotational position of the bearing sleeve and the main handle housing relative to the head portion of the swivel handle housing.

14 Claims, 2 Drawing Sheets

FORCED HOT AIR APPLIANCE WITH SWIVEL HANDLE

BACKGROUND OF THE INVENTION

Field of the Invention

The present invention relates t forced hot air appliances, and more particularly to forced hot air appliances such as curling irons and hot air brushes which utilize a swivel handle.

The Prior Art

Forced hot air appliances which have handles that can swivel are known. See, for example, U.S. Pat. Nos. 3,731,694 and 4,469,934. However, since October of 1987Underwriter Laboratories (UL) has required that the switches in all hand held drying devices be waterproof when in their off position. Although there are currently many UL-approved hair dryers and hot air brushes which meet this standard, none have swivel handles. Such appliances are very cumbersome to use because in use their electrical cords become twisted and tangled.

SUMMARY OF THE INVENTION

It is an object of the present invention to provide a forced hot air appliance such as a curling iron or an air brush which utilizes a submersible (waterproof) switch and which has a swivel handle.

According to the present invention the appliance includes a main handle assembly which includes a generally tubular main handle housing that contains a heater and a ventilator; a bearing assembly which includes a generally tubular bearing sleeve that is fixedly supported by a rear end of the main handle housing and which includes a rear portion that extends away from the rear end of the main handle housing, and two metallic contact rings that are positioned around the rear portion of the bearing sleeve; and a swivel handle assembly which includes a swivel handle housing in which the projecting portion of the bearing sleeve rotatably extends, the swivel handle housing containing a submersible (waterproof) switch which includes two metallic contact paddles that extend substantally perpendicularly to the bearing sleeve and are in contact with the two respective metallic contact rings, the two metallic contact paddles being in continuous contact with the two metallic contact rings regardless of the rotational orientation of the bearing sleeve and the main handle housing relative to the swivel handle housing.

The invention will be better understood by reference to the accompanying drawings, taken in conjunction with the following discussion.

DETAILED DESCRIPTION OF THE PREFERRED EMBODIMENT

A preferred forced hot air appliance in the form of a forced hot air curling iron is shown in FIGS. 1-5. It includes a main handle assembly 10, a barrel assembly 40, a bearing assembly 50, and a swivel handle assembly 70. The construction and interaction of these assemblies will now be discussed in detail.

Figures 3, 5:
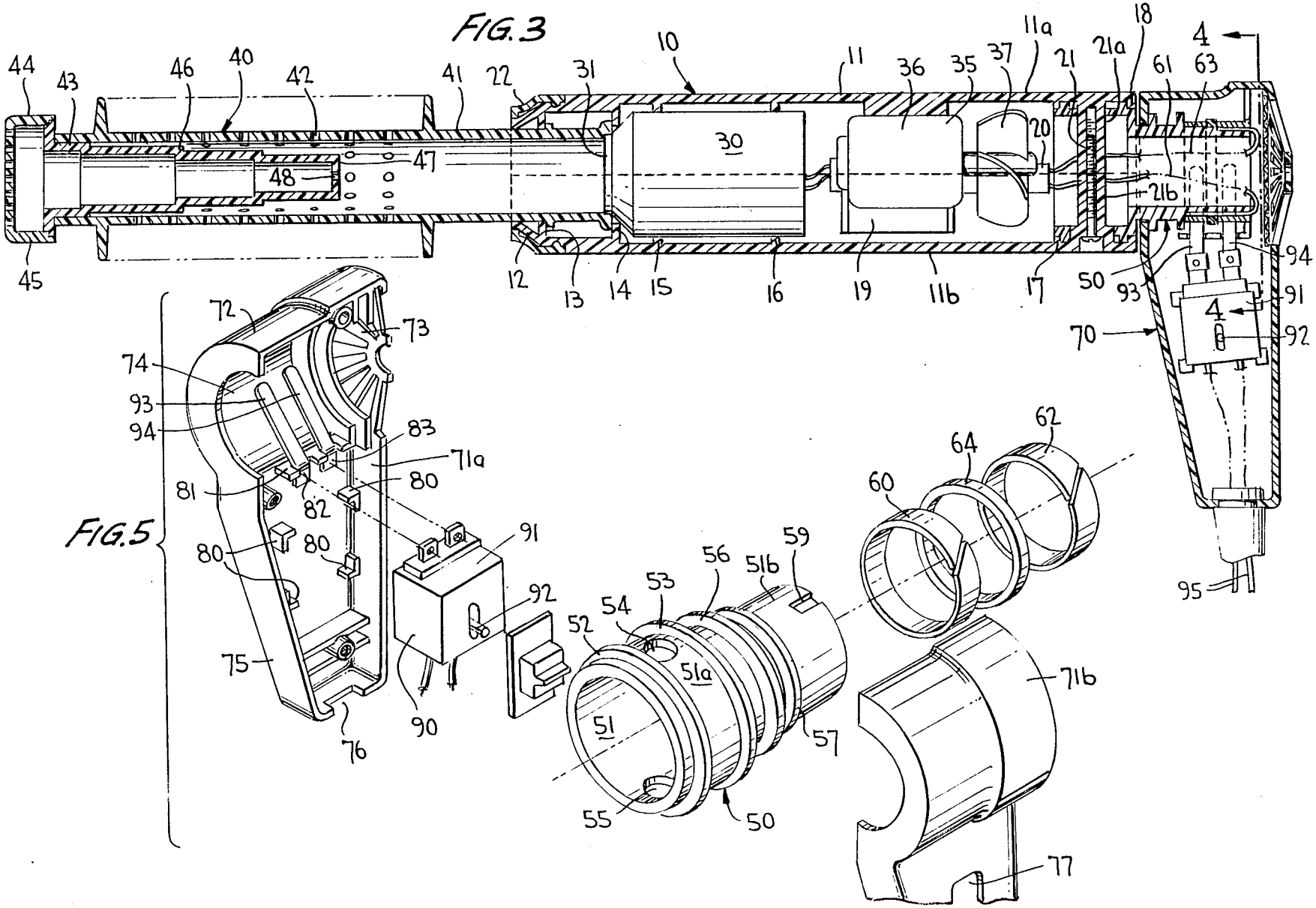
FIG. 3 is a longitudinal cross sectional view of the forced hot air curling iron shown in FIG. 1.
FIG. 5 is an exploded view of both the swivel handle assembly and the bearing assembly which connects the swivel handle assembly with the main handle assembly of the forced hot air curling iron of FIG. 1, the electical wires connected to the contact rings of the bearing assembly again being omitted for clarity .

As seen in FIG. 3, the main handle assembly 10 includes a generally tubular main handle housing 11, a heater means 30 and a ventilator means 35. The housing 11 is actually formed of interconnected housing half sections 11a and 11b which are preferably made of heat and impact resistant plastic. The housing 11 provides a mouth 12 of reduced cross section at its front end, a plurality of radially inwardly-extending flanges 13–18 along its length, mounting means 19 located between the flanges 16 and 17, a guide channel 20 extending between the flanges 16 and 17, and a diametric screw channel 21 located between the flanges 17 and 18. The flanges 13 and 14, together with the mouth 12, rotatably support the rear end of a hair curling tube 41 of the barrel assembly 40, whereas the flanges 15 and 16 support the heater means 30 so that its outlet mouth 31 fits within the interior of the hair curling tube 41. The mounting means 19 supports the motor 36 of the ventilator 35 so that its associated fan blade 37 faces the rear end of the housing 11. The flanges 17 and 18 cooperate with annular projections 52 and 53 on the bearing sleeve 51 of the bearing assembly 50 to support the bearing sleeve at the rear end of the housing. The diametic screw channel 21, which is actually formed of abutting channel portions **21*a* and 21*b* that extend radially inwardly from the respective housing half sections 11*a* and 11*b*, functions to connect the two housing half sections together, i.e., when a screw is inserted therein to extend between the abutting channel portions. The diametric screw channel also helps to fix the bearing sleeve in position within the rear end of the housing, i.e., by extending through aligned holes 54 and 55 in the bearing sleeve. The housing half sections 11*a* and 11*b* are also connected together by a locking ring 22 which snap fits over the mouth 12 at the front end of the handle housing 11**.

The barrel assembly 40 includes a hair curling tube 41 which has perforations 42 therein, and a flow divider element 43. The flow divider element includes a hollow head 44 which includes lateral perforations 45, and a stepped hollow body 46 which extends from the head 44 into the hair curling tube to an end surface 47 having an opening 48. The stepped body 46 functions to control the flow of hot air through the perforations 42 of the hair curling tube 41, while the lateral perforations 45 of the head 44 enable the head 44 to remain cool. The head 44 is attached to the front end of the hair curling tube 41 by ultrasonic welding.

Figure 1:
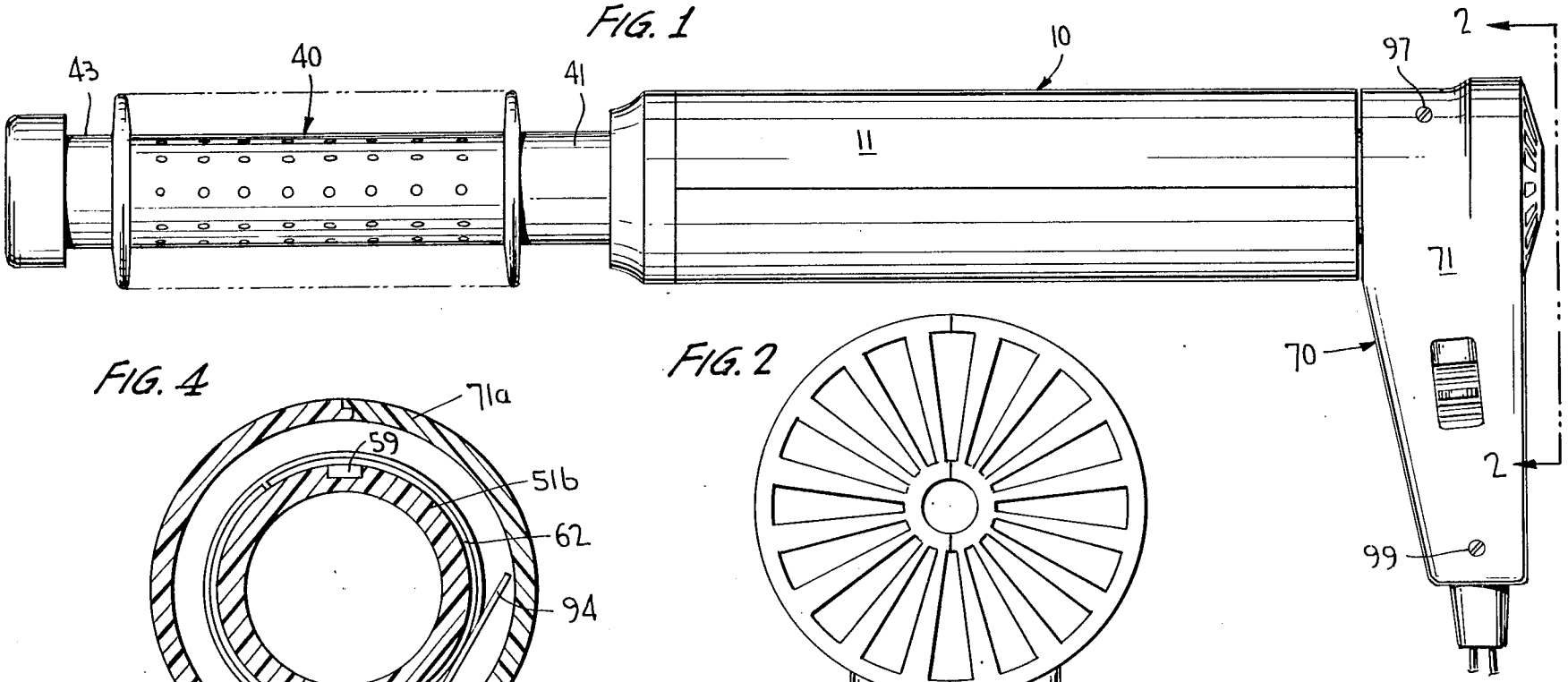
FIG. 1 is an elevational side view of a forced hot air curling iron constructed in accordance with the present invention.
Figure 2:
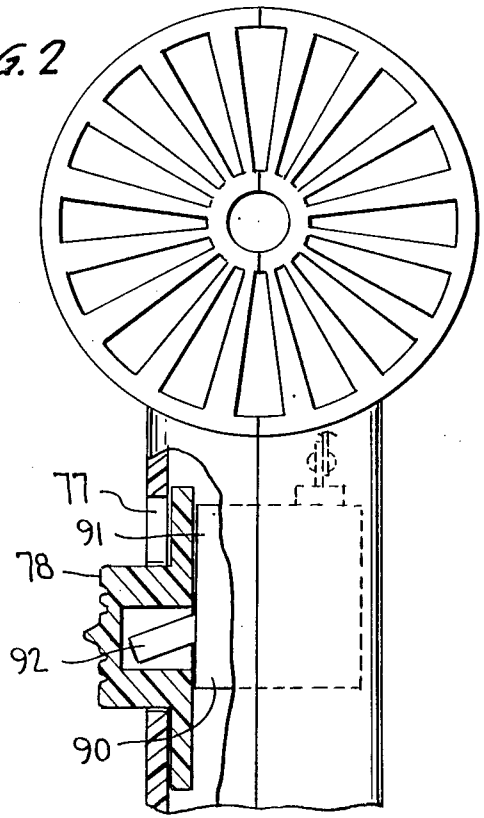
FIG. 2 is a rear end view of the forced hot air curling iron as seen along line 2—2 in FIG. 1, a portion of the depicted swivel handle housing being broken away to show the cooperating arrangement of the actuator cap of the housing and the lever of the switch (otherwise shown in phantom) within the housing.
Figure 4:
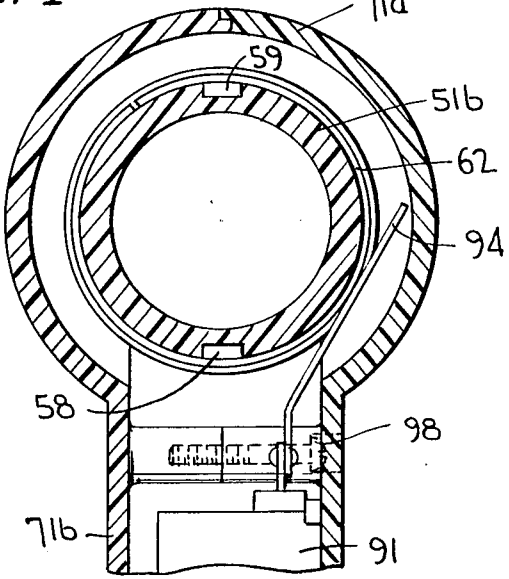
FIG. 4 is a cross sectional view as seen along line 4-4 in FIG. 3, the electrical wires connected to the contact rings of the bearing assembly being omitted for clarity.

As best seen in FIGS. 1 and 5, the bearing assembly 50 includes a generally tubular bearing sleeve 51, a pair of metallic contact rings 60 and 62 having attached electrical wires 61 and 63, and an insulator ring 64. The bearing sleeve 51 includes a front portion 5la of a first diameter and a rear portion 51*b* of a second, smaller diameter. The front portion 51*a* includes annular projections 52 and 53 and aligned openings 54 and 55 therebetween, the projections 52 and 53 being spaced so as to abut the flanges 17 and 18 in the rear portion of the main handle housing 11 (as noted previously). The aligned holes 54 and 55 accomodate the channel portions 21*a* and 21*b* of the tubular screw channel 21. The rear portion 5l*b* includes annular projections 56 and 57 and diametrically opposed grooves 58 and 59. The annular projection 56 functions to rotatably mount the bearing sleeve in the swivel handle housing of the swivel handle assembly 70 (as discussed below), while the annular projection 57 provides a stop for the metallic contact ring 60.

More specifically, the contact ring 60 is positioned around the rear portion 5lb of the bearing sleeve so as to abut the annular projection 57 and so that its attached electrical wire 61 extends along the groove 58 (see FIG. 4) and into the bearing sleeve, the insulator ring 64 is positioned around the rear portion 51*b* so as to contact the contact ring 60, and the contact ring 62 is positioned around the rear portion 5l*b* so as to contact the insulator ring 64 and so that its attached electrial wire 63 extends along the groove 59 and into the bearing sleeve. The electrical wires 61 and 63 extend through the bearing sleeve 51 and into the main handle housing 11, where they pass through the guide channel 20 (so as not to become entangled with the fan blade 37), and finally connect with the motor 36 and the heater means 30.

The swivel handle assembly 70 includes a swivel handle housing 71 and a submersible (waterproof) switch 90, which is composed of a switch box 91 having an on/off lever 92, two metallic contact paddles 93 and 94 extending away from the top of the switch box, and cable means 95 for connecting the switch box to a source of electricity. The swivel handle housing 71 is formed of two swivel handle housing half sections 71*a* and 71*b* which are preferably made of heat and impact resistant plastic. The swivel handle housing 71 provides a head portion 72 and a body portion 75. The head portion 72 has a rear end which defines an air inlet screen 73 and a front end which defines a circular opening 74. The body portion 75 provides an inlet opening 76 at an end thereof opposite the head portion 72 (through which the electrical cable means 95 passes), a slot 77 along a side thereof, and an actuator cap 78 which is slidable along the slot 77 and which encloses the on/off lever 92. The two swivel housing half sections both provide brackets 80 for mounting the switch box 91 (only the brackets on swivel housing half section 71*a* are shown in FIG. 5), and the swivel housing half section 71*a* includes a bracket 81 with spaced slots 82 and 83 for the metallic contact paddles 93 and 94. The metallic contact paddles 93 and 94 extend substantially perpendicularly to the bearing sleeve 51. The swivel housing half sections are suitably connected together by screws 97, 98 and 99 (see FIGS. 1 and 4).

As can be appreciated from FIG. 3, the metallic contact paddles 93 and 94 will always be in contact with the metallic contact rings 60 and 62 so as to supply electrical power to the ventilator means 35 and the heater means 30, i.e., regardless of the rotational orientation of the bearing assembly, the main handle assembly and the barrel assembly with respect to the swivel handle assembly. At the same time, the switch box 91 is mounted in the swivel handle housing so as to be advantageously out of the air stream which flows from the air inlet screen 73 to the circular opening 74 (caused by operation of the ventillator means 35).

Although an advantageous embodiment of the invention has been shown and described in detail, obvious modifications therein can be made and still fall within the scope of the appended claims.

We claim:

1. A forced hot air appliance which comprises:

a main handle assembly which includes a main handle housing that is generally tubular and which defines a front end and a rear end, a heater means which is mounted within the main handle housing for heating air which flows therepast, and a ventilator means which is mounted within the main handle housing for forcing air to flow through said main handle housing from the rear end to the front end thereof and past the heater means therein, a bearing assembly which includes a generally tubular bearing sleeve having a front portion that is fixedly mounted in the rear end of the main handle housing and a rear portion that extends away from the rear end of the main handle housing, two separated metallic contact rings which are positioned around the rear portion of the bearing sleeve, and two electrical wires which are respectively connected to the two contact rings and which extend through the bearing sleeve and connect to the ventillation means and the heater means in the main handle housing, and a swivel handle assembly which includes a swivel handle housing that provides a head portion and a body portion, the head portion having a rear end which defines an air inlet screen and a front end which defines a circular opening through which the rear portion of the bearing sleeve extends for enabling the bearing sleeve and the main handle housing to be rotatably supported by the swivel handle housing, and a submersible switch means which is mounted within the swivel handle housing, the submersible on/off switch means including a switch box and two spaced apart metallic contact paddles which extend away from the switch box and which contact the respective metallic contact rings on the bearing sleeve of the bearing assembly regardless of the rotational position of the bearing sleeve and the main handle housing relative to the head portion of the swivel handle housing.

2. A forced hot air appliance according to claim 1, wherein the bearing assembly includes an insulator ring positioned around the rear portion of the bearing sleeve between the two metallic contact rings.

3. A forced hot air appliance according to claim 1, wherein the ventilator means is mounted in the main handle housing between the rear end of the main handle housing and the heater means.

4. A forced hot air appliance according to claim 1, wherein the front portion of the bearing sleeve has a first diameter and the rear portion of the bearing sleeve has a second diameter, the first diameter being larger than the second diameter.

5. A forced hot air appliance according to claim 4, wherein the bearing sleeve includes an annular projection extending outwardly from the rear portion thereof which has a larger outer diameter than the diameter of the circular opening in the front end of the head portion of the swivel handle housing for preventing separation of the bearing sleeve and the main handle housing from the swivel handle housing.

6. A forced hot air appliance according to claim 5, wherein the rear portion of the bearing sleeve includes two grooves therein in which the electrical wires attached to the two metallic contact rings respectively extend.

7. A forced hot air appliance according to claim 1, further comprising a barrel assembly which includes a perforated hair curling tube having a rear end which is supported in the front end of the main handle housing.

8. A forced hot air appliance according to claim 7, wherein the hair curling tube has a front end and wherein the barrel assembly includes a flow divider element attached to the front end of the hair curling tube, the flow divider element including a hollow head having lateral perforations.

9. A forced hot air appliance according to claim 8, wherein the flow divider element includes a hollow body which extends from the head into the hair curling tube to an end surface having a opening therein.

10. A forced hot air appliance according to claim 9, wherein the hollow body of the flow divider element is stepped.

11. A forced hot air appliance according to claim 1, wherein the main handle housing is formed of two interconnected main handle housing half sections.

12. A forced hot air appliance according to claim 1, wherein the swivel handle housing is formed of two interconnected swivel handle housing half sections.

13. A forced hot air appliance according to claim 12, wherein one of the two swivel handle housing half sections includes a slot and an actuator cap movable along the slot, and wherein the switch box of the submersible switch means includes an on/off lever which extends into the actuator cap, movement of the actuator cap by a user causing the lever to be in either its on or its off position.

14. A forced hot air appliance according to claim 1, wherein the two metallic contact paddles of the submersible switch means extend substantially perpendicularly to the bearing sleeve.

* * * * *